United States Patent [19]

Hirano

[11] 4,166,322

[45] Sep. 4, 1979

[54] RULERS FOR MAKING AXONOMETRIC PROJECTION DRAWINGS

[76] Inventor: Akira Hirano, 178, Shin-Karasuma-Kashiramachi, Kamigyoku, Kyoto City, Kyoto, Japan

[21] Appl. No.: 831,997

[22] Filed: Sep. 9, 1977

[51] Int. Cl.[2] ..... B43L 13/14

[52] U.S. Cl. ..... 33/432; 33/482

[58] Field of Search ..... 33/104, 77

[56] References Cited

U.S. PATENT DOCUMENTS

| | | | |
|---|---|---|---|
| 1,723,517 | 8/1929 | McFadden | 33/104 |
| 2,713,205 | 7/1955 | Nielsen | 33/104 |
| 3,604,118 | 9/1971 | Miller | 33/104 |
| 3,711,953 | 1/1973 | Chandronnait | 33/77 |

FOREIGN PATENT DOCUMENTS

| | | | |
|---|---|---|---|
| 1186549 | 2/1959 | France | 33/104 |
| 449421 | 6/1949 | Italy | 33/104 |
| 563318 | 8/1944 | United Kingdom | 33/104 |

OTHER PUBLICATIONS

"History of Geometric" by Peter J. Booker, published by Misuzu Shobo Co.

"Graphics for Engineers" by Randolph P. Hoelscher et al.

*Primary Examiner*—Harry N. Haroian

*Attorney, Agent, or Firm*—Armstrong, Nikaido, Marmelstein & Kubovcik

[57] ABSTRACT

A ruler of transparent material having a first edge parallel to one of the three main projection axes of an axonometric projection drawing and a second edge at a specified angle $\gamma$ with one of the remaining two main projection axes. The ruler is provided on its front surface with a standard line sloping at a specified inversion angle with respect to the first edge and another standard line sloping at the inclination angle of an orthographic projection drawing with respect to the bisector of the inversion angle. An axonometric projection drawing can be made with the use of the ruler from a plan view and a front or side view drawn by orthographic projection and placed on a drawing board as arranged in the orthographic drawing.

15 Claims, 14 Drawing Figures

RULERS FOR MAKING AXONOMETRIC PROJECTION DRAWINGS

BACKGROUND OF THE INVENTION

A method of making axonometric projection drawings from orthographic projection drawings is described in "Graphics for Engineers" written by R. P. Hoelscher et al. and published by John Wiley & Sons, Inc. This method involves the troublesome procedure of arranging separate front view and plan view on a drawing board in a specified relationship relative to each other. "Seizu no Rekishi (History of Drawing)," written by Peter J. Booker (translated by Masatoshi Hara) and published by Misuzu Shobo of Japan describes a method of making a specific axonometric projection drawing from an orthographic projection drawing as drafted. However, these references mention nothing about the making of desired axonometric projection drawings and rulers for making such drawings.

I contrived a novel method of making desired axonometric projection drawings from orthographic projection drawings and provided a drawing instrument for use in drafting such drawings on which U.S. Pat. No. 3,867,762 has been granted. With reference to FIG. 1, the method will be described below of making an axonometric projection drawing from a plan view and a front view of a cube drafted by orthographic projection.

A vertical line UV of an orthographic projection drawing is inclined clockwise through an angle $\phi$ with respect to a vertical line $N_1N_2$. The intersection of the lines UV and $N_1N_2$ is indicated at $O_1$. The angle $\phi$ will be referred to as the inclination angle of orthographic projection drawing. The line UV may be inclined counterclockwise with respect to the line $N_1N_2$, in which case an axonometric projection drawing of the cube will be obtained as it is seen from above on the left-hand side. Parallel lines La, Lc, Le, . . . sloping downward at an angle $\alpha$ with respect to a horizontal line are drawn through the corner points of a front view PLV of the orthographic projection drawing which is placed as inclined at the angle $\phi$. Upwardly extending lines Ma, Mb, Mc, . . . are then drawn through the corner points of a plan view PLH at an angle of $\beta$, i.e. $90°-\theta$ with respect to a horizontal line to provide intersections Ta, Tb, Tc, . . . on a horizontal line $T_1T_2$. Lines Na, Nb, Nc, . . . are drawn from the intersections Ta, Tb, Tc, . . . at an angle with respect to perpendiculars to the line $T_1T_2$, the angle being equal to an angle $\theta$ between the perpendiculars and the lines Ma, Mb, Mc, . . . Lines connecting the intersections a, b, c, . . . of the lines La and Na, lines La and Nb, lines Lc and Nc provide an axonometric projection drawing. In this method of drawing, ad, ab, ae will be termed main projection axes, and the angle $2\theta$ an inversion angle.

As will be described later, the values of the angles $\alpha$, $\beta$, $\phi$ and $2\theta$ are determined in accordance with the kind of the axonometric projection drawing desired. The lines Ma, Mb, Mc, . . . can be regarded as the light beams emitted from the points of the plan view PLH and reflected by the horizontal line $T_1T_2$ as indicated at Na, Nb, Nc, . . . Accordingly, this projection method will be termed "the plan view emitter method." Like the plan view emitter method, the front view emitter method is feasible. Although axonometric projection drawings have heretofore been made from orthographic projection plan view and front view, they can be made also from orthographic projection front view and side view. In this case, the drawings can be made also by the front view emitter method and side view emitter method. FIG. 2 shows a case in which an axonometric projection drawing is made from orthographic projection front view and side view by the front view emitter method.

This invention discloses rulers for use in making axonometric projection drawings by the emitter method.

SUMMARY OF THE INVENTION

The rulers of this invention is made from a transparent synthetic resin plate or made predominantly from such transparent plate in a shape having particular angles in conformity with the kind of axonometric projection drawings to be made as will be described later in detail.

The rulers have a first edge parallel to one of the three main projection axes of an axonometric projection drawing, a second edge at a specified angle $\gamma$ with one of the remaining two main projection axes, a standard line sloping at an angle equal to an inversion angle $2\theta$ with respect to the first edge, and another standard line intersecting the bisector of the inversion angle $2\theta$ at an angle equal to an inclination angle $\phi$. An axonometric projection drawing can be made from an orthographic projection drawing with the use of the ruler.

Drawings can be made with ease using the ruler of this invention as attached to a drawing instrument including means for effecting horizontal, vertical and rotational movements and locking means for stopping such movements.

DETAILED DESCRIPTION OF THE INVENTION

Figure 3:
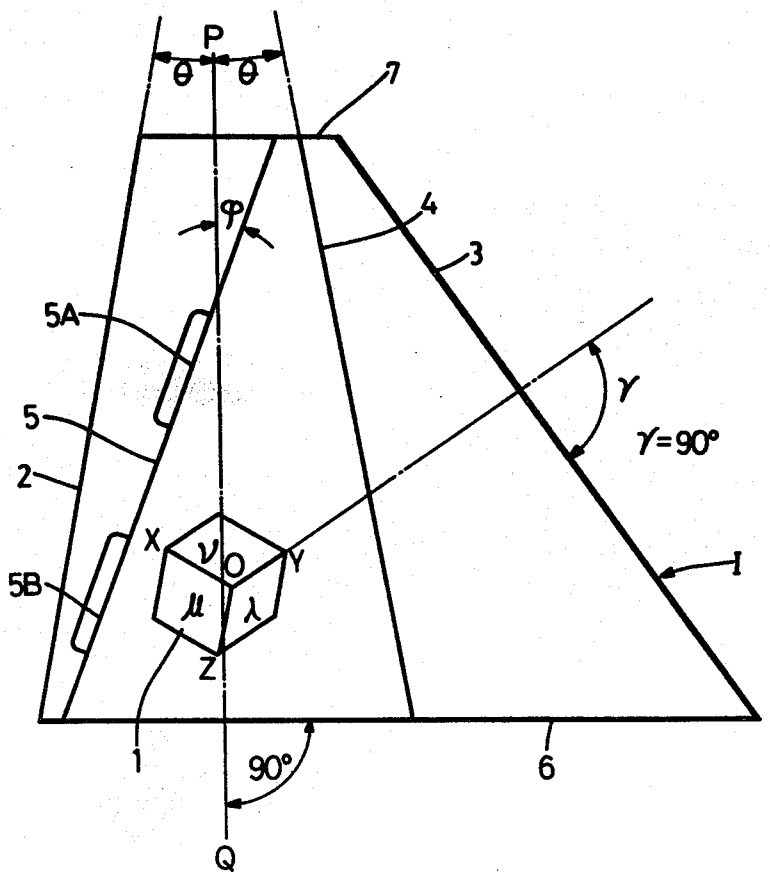
FIG. 3 is a front view of a ruler of this invention.

FIG. 3 shows a ruler I made of transparent synthetic resin plate and in the form of a quadrilateral having a first sloping edge 2, a second sloping edge 3, a base side 6, and a top side 7. Indicated on the surface of the ruler is an axonometric projection drawing 1 of a cube. Marked on the drawing 1 are projection angles $\lambda$, $\mu$ and $\nu$ formed by the projecting lines and the three faces, namely the three main axis planes of the original cube at right angles to each other, the angles being indicated on corresponding faces OYZ, OZX and OXY respectively. The first edge 2 is parallel to the main projection axis OZ of the axonometric projection drawing 1, and the second edge 3 is at an angle of 90° with respect to the main projection axis OY. The ruler is further provided on its surface with a standard line 4 forming an angle equal to an inversion angle $2\theta$ with the first edge 2. The ruler surface further bears a standard line 5 inclined rightward by an angle equal to the inclination angle $\phi$ of orthographic projection drawing with respect to the phantom bisector PQ of the inversion angle $2\theta$.

Either one or both of the base side 6 and the top side 7 are perpendicular to the phantom line PQ. Slots are formed along the standard line 5 to provide edges 5A and 5B coinciding with the standard line 5. The angle $\gamma$ formed by the second edge 3 and the main projection axis OY can be determined as desired. However, for the convenience of use, the angle $\gamma$ is 90° in this embodiment. The second edge 3 is therefore perpendicular to the main projection axis OY.

The ruler I of FIG. 3 is used for making axonometric projection drawings in combination with a drawing instrument equipped with locking means for holding a protractor in place or with a T-square.

Figure 4:
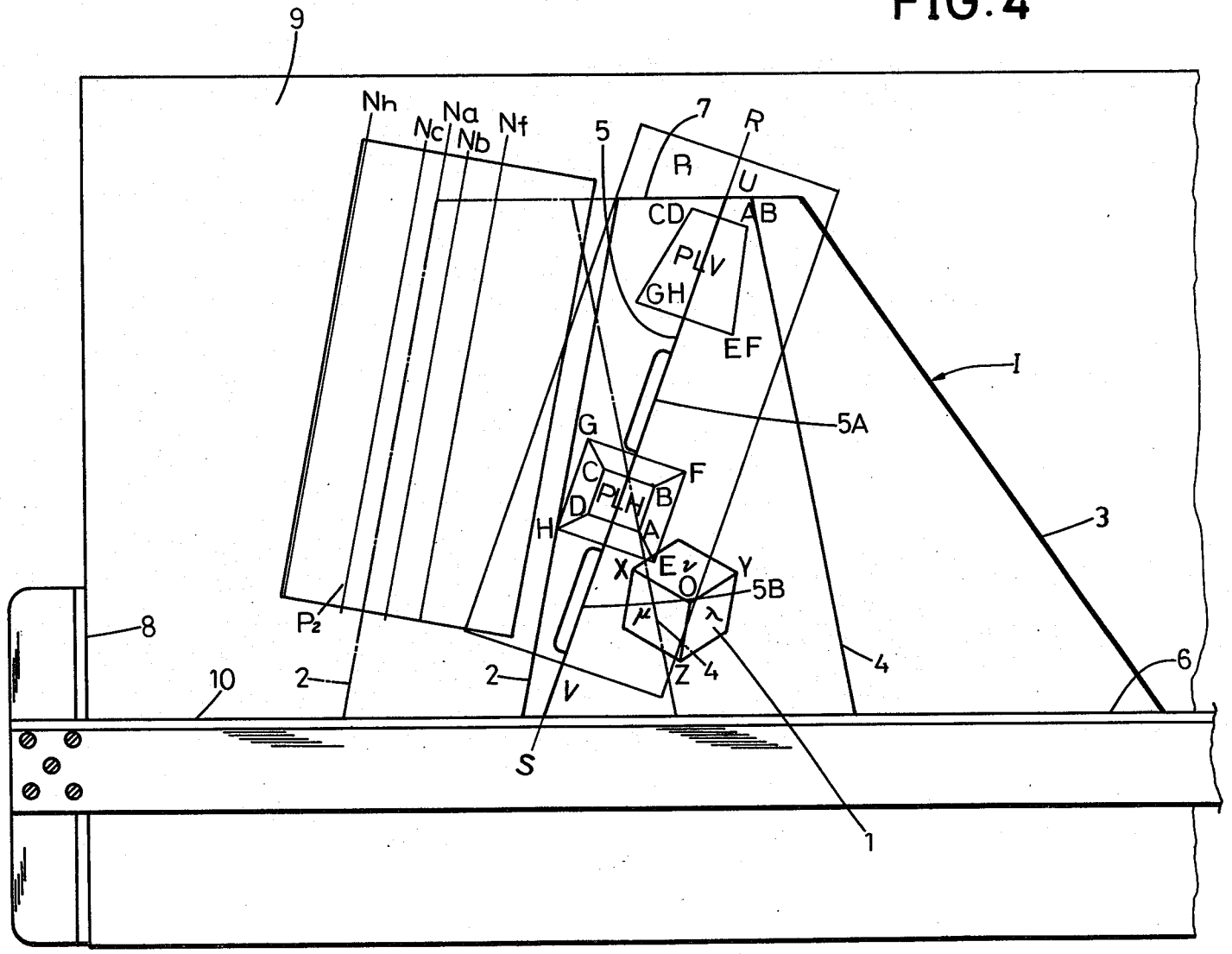
FIGS. 4 and 5 are views illustrating how an axonometric projection drawing is made with use of the ruler of this invention, a T-square and a set square.
Figure 5:
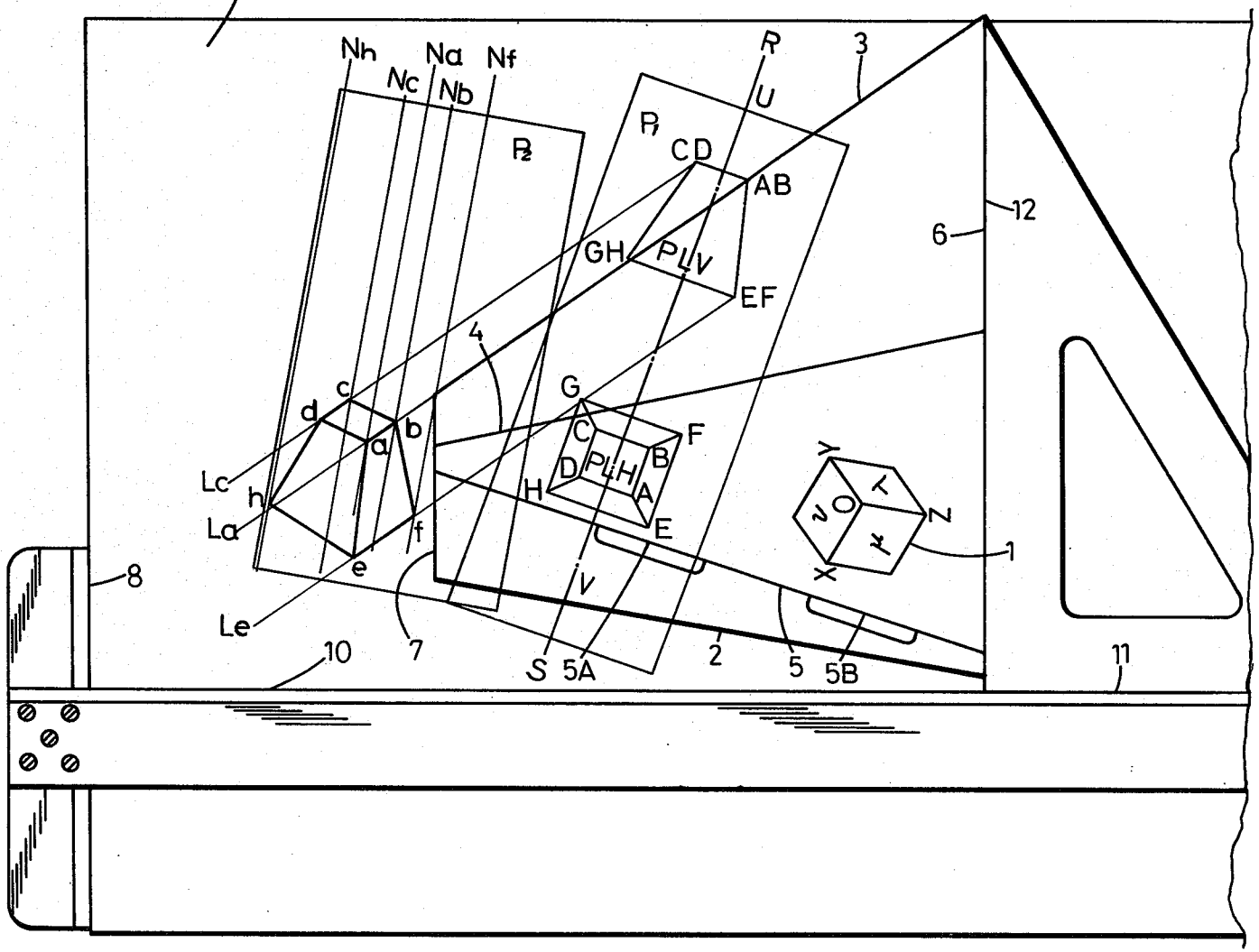

With reference to FIGS. 4 and 5, a method will be described below of making an axonometric projection drawing of a truncated pyramid from an orthographic projection plan view PLH and an orthographic projection front view PLV thereof with the use of a T-square and the ruler I whose base side 6 is perpendicular to the phantom line PQ.

(1) Hold the straight head portion 8 of the T-square in intimate contact with the left side of a drawing board 9 with a sheet of drawing paper adhered to the board. Fit the ruler I to the straight blade portion 10 of the T-square as indicated in FIG. 4. Draw a line RS along the edges 5A and 5B.

(2) Fixedly secure a sheet of tracing paper $P_1$ bearing an orthographic projection drawing of the truncated pyramid to the drawing paper with the vertical line UV of the drawing in register with the line RS.

(3) Securely place a new sheet of tracing paper $P_2$ on the left side of the ruler I with the longitudinal edge of the sheet $P_2$ in parallel to the edge 2 of the ruler I.

(4) Horizontally slide the base side 6 of the ruler I along the straight portion 10 of the T-square held in position to place the standard line 4 on one point (point A shown) of the plan view PLH. Draw a line Na along the edge 2. Similarly, draw lines Nb, Nc, . . .

(5) Place an inequilateral triangle near the right end of the straight blade portion 10 of the T-square, fitting the shorter side 11 of the two sides forming a right angle to the blade portion 10.

(6) Turn the ruler I through 90°, and slide the base side 6 of the ruler I along the longer side 12 of the triangle. Draw a line La through one point (point AB shown) of the front view PLV along the edge 3.

To coincide the edge 3 of the ruler I to the point EF, slide the side 11 of the triangle rightward along the blade portion 10 of the T-square with the base side 6 of the ruler I intimately fitted to the side 12 of the triangle. In this way, draw lines La, Lc, Le, . . . through all the points of the front ivew PLV.

(7) Draw lines connecting the intersections a, b, c, . . . of the lines La and Na, lines Lb and Nb, lines Lc and Nc, . . . drawn through points A, points B, points C, . . . representing the same points respectively on the orthographic projection drawing, and an axonometric projection drawing will be obtained.

When the top side 7 of the ruler is perpendicular to the phantom line PQ, fit the head 8 of the T-square to the right edge of the drawing board in the step (1) of the foregoing procedure. In the step (4) above, fit the top side 7 of the ruler I to the blade portion 10 of the T-square. In the step (5), place the triangle on the left-hand side of the drawing board and slide the top side 7 along the side of the triangle, whereby like drawing will be made.

Axonometric projection drawings can be made with the use of the ruler I for the following reasons.

Figure 2:
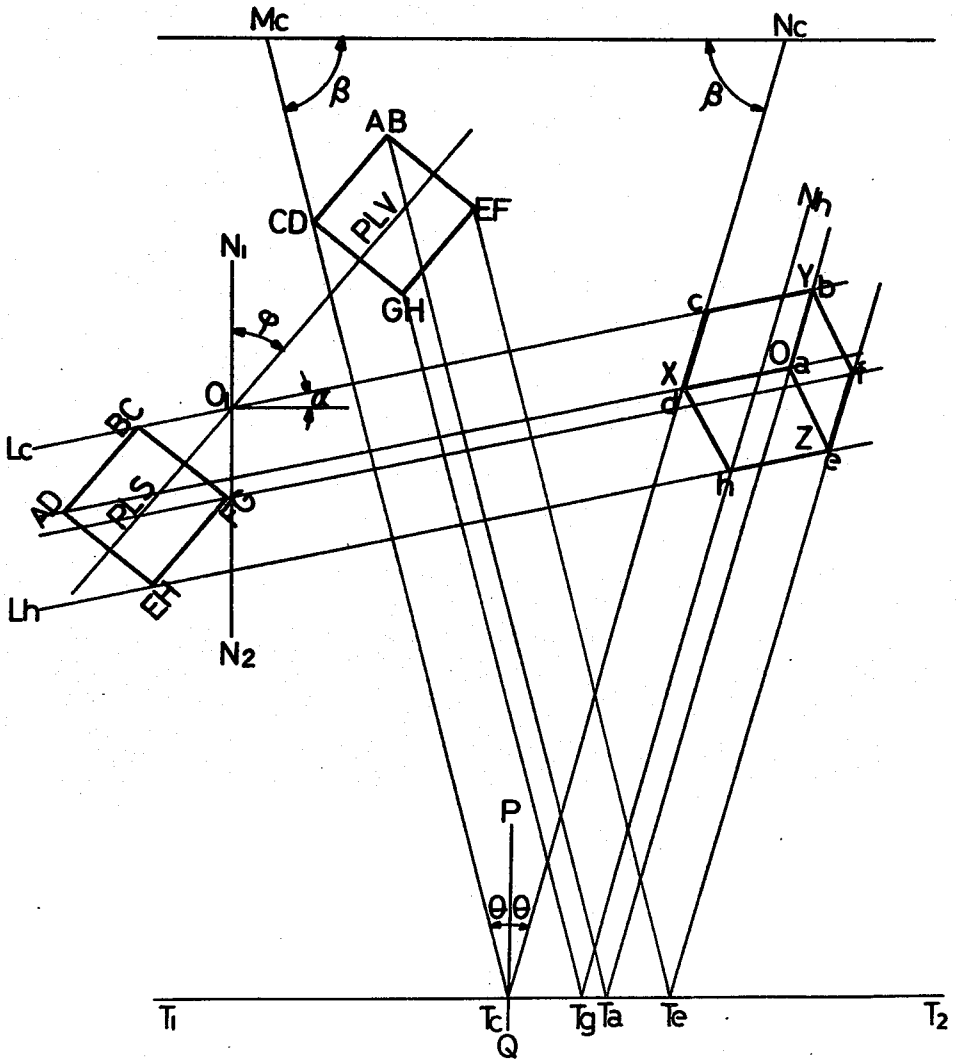
FIG. 2 is a view illustrating the emitter method by which an axonometric projection drawing is made from a front view and a side view of a cube drafted by orthographic projection.
Figure 1:
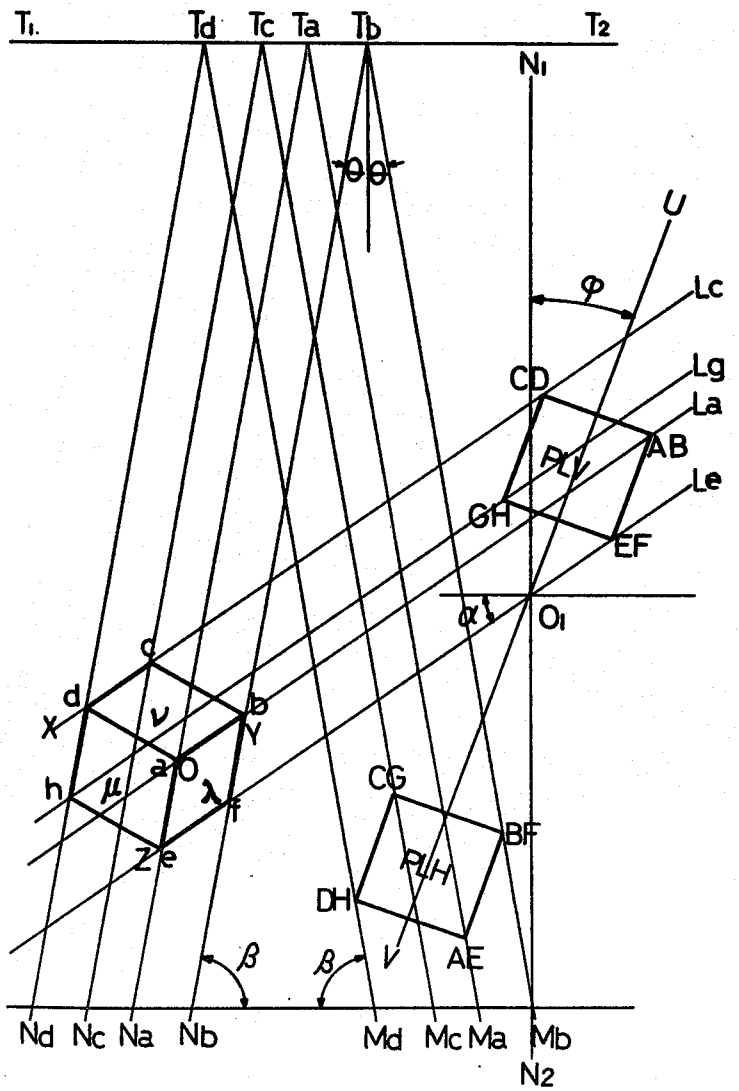
FIG. 1 is a view illustrating the emitter method by which an axonometric projection drawing is made from a front view and a plan view of a cube drafted by orthographic projection.

The edge 3 of the ruler I is at an angle of 90° with the main projection axis OY. Since the ruler has been turned through 90° in FIG. 5, the edge 3 forms an angle of $90°+90°=180°$ with the main projection axis OY on the ruler I. Thus, the edge 3 is positioned in the same direction as the main projection axis OY. It will be apparent that the edge 3 is in the same direction as the line La, Lb, . . . in FIG. 1. The group of lines La, Lc, Le, . . . drawn through the points of the view PLV with use of edge 3 of the ruler I are identical with the lines La, Lc, Le, . . . drawn in FIG. 1. The step of drawing lines Na, Nb, Nc, . . . in FIG. 4 along the edge 2 with the standard line 4 placed successively on the points of the plan view PLH by virtue of the horizontal sliding movement of the ruler I is identical with the step of drawing the lines Ma and Na, lines Mb and Nb, . . . in FIG. 1. Thus, the lines connecting the intersections a, b, c, . . . give an axonometric projection drawing.

Figure 6:
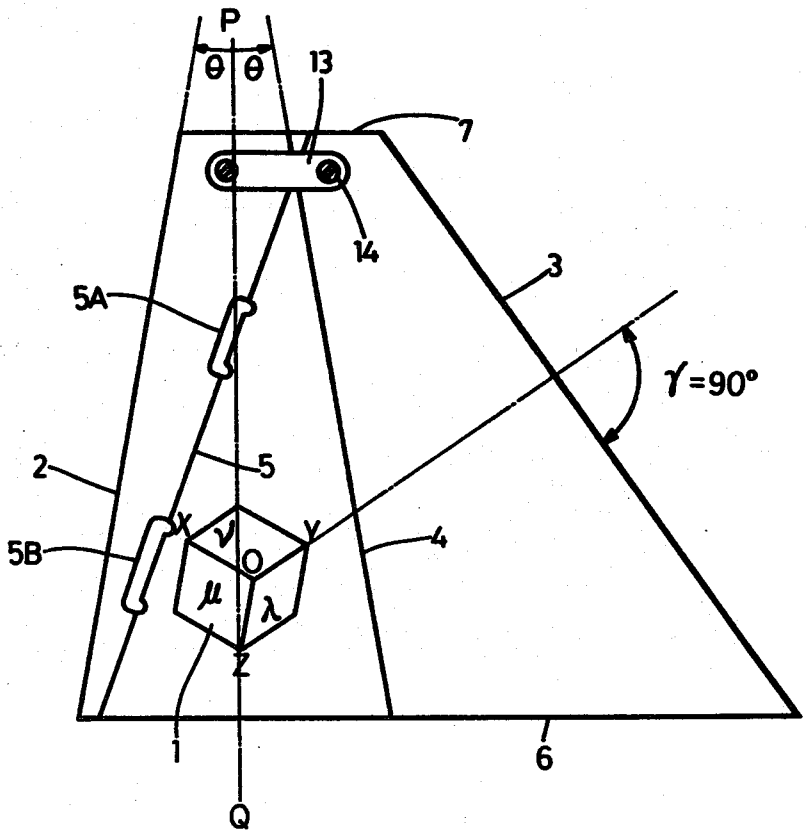
FIG. 6 is a front view of the ruler of this invention equipped with an attaching member.

FIG. 6 shows another embodiment of the ruler for making axonometric projection drawings according to this invention. This embodiment comprises the same ruler as the ruler I shown in FIG. 3. The ruler is provided with an attaching member 13 positioned close to the top side 7 and secured to the ruler by two screws 14, 14. The attaching member is so arranged that the line through the center points of the screw holes of the member 13 intersects the phantom line PQ at right angles. The base side 6 and the top side 7 need not be perpendicular to the phantom line PQ. With this embodiment, the second edge 3 forms an angle $\gamma$ of 90° with the main projection axis OY of the axonometric projection drawing 1.

Figure 7:
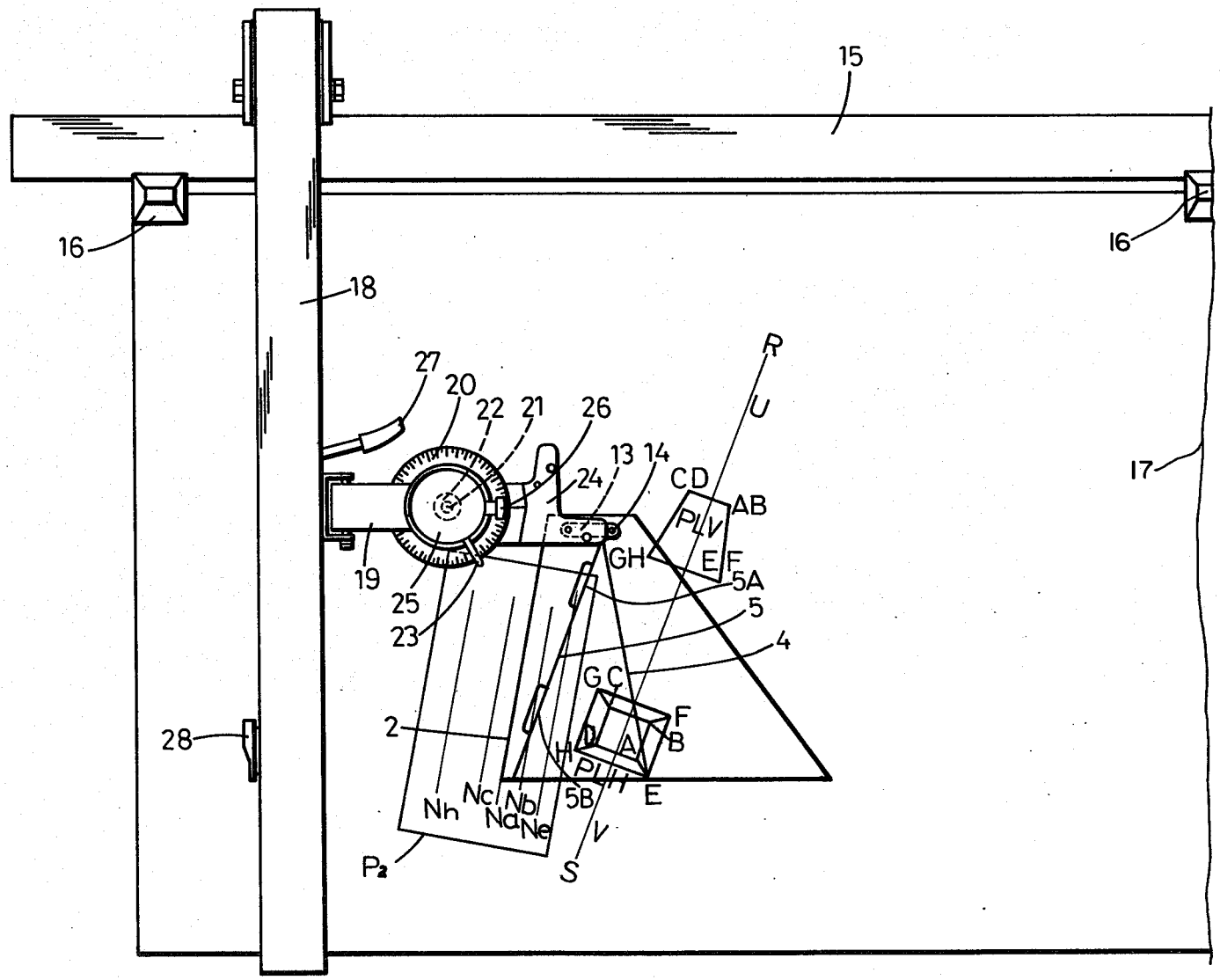
FIGS. 7 and 8 are views illustrating the ruler of FIG. 6 while it is being used for drawing as attached to a drawing instrument.

FIG. 7 shows the ruler of FIG. 6 as it is attached to a drawing instrument of the rail type. The drawing instrument comprises a horizontal rail 15 mountable in its horizontal position on the upper edge of a drawing board 17 by vices 16 and a vertical rail 18 horizontally movable in its vertical position by being guided by the horizontal rail 15. The vertical rail 18 is provided with an arm 19 which is vertically slidable. The arm 19 carries a protractor 20 with its shaft 21 rotatably supported by a bearing 22. The protractor 20 can be locked to or released from the bearing 22 by turning a lever 23. A ruler mounting arm 24 is rotatable about the protractor 20 and integral with a knob 25. The ruler mounting arm 24 is lockable to the protractor 20 by depressing the index lever 26 and turning the lever 26 clockwise. The arm 19 on the vertical rail 18 is lockable by a lever 27 to the vertical rail 18. The vertical rail 18 is lockable to the horizontal rail 15 by a lever 28.

The instrument described will be used in the following manner. First, the index lever 26 is turned clockwise to lock the ruler mounting arm 24 to the protractor 20, and the lever 23 is turned clockwise to lock the protractor 20 to the arm 19. When the knob 25 is moved vertically and horizontally, the vertical rail 18 moves horizontally and the arm 19 moves vertically. Thus, the arm 24 is movable as desired.

The lever 27, when turned clockwise to lock the arm 19 to the vertical rail 18, renders the arm 19 immovable vertically, permitting the knob 25 to move only horizontally and allowing the ruler mounting arm 24 to move with the vertical rail 18 horizontally sidewise.

In the same manner as already described with reference to the embodiment of FIG. 3, orthographic projection front view PLV and plan view PLH and a sheet of paper $P_2$ on which an axonometric projection drawing is to be made are arranged as seen in FIG. 7. The standard line 4 is placed successively on the respective points of the plan view PLH by laterally moving the arm 24 in parallel to the horizontal rail 15 to draw lines Na, Nb, Nc, . . . along the first edge 2.

Figure 8:
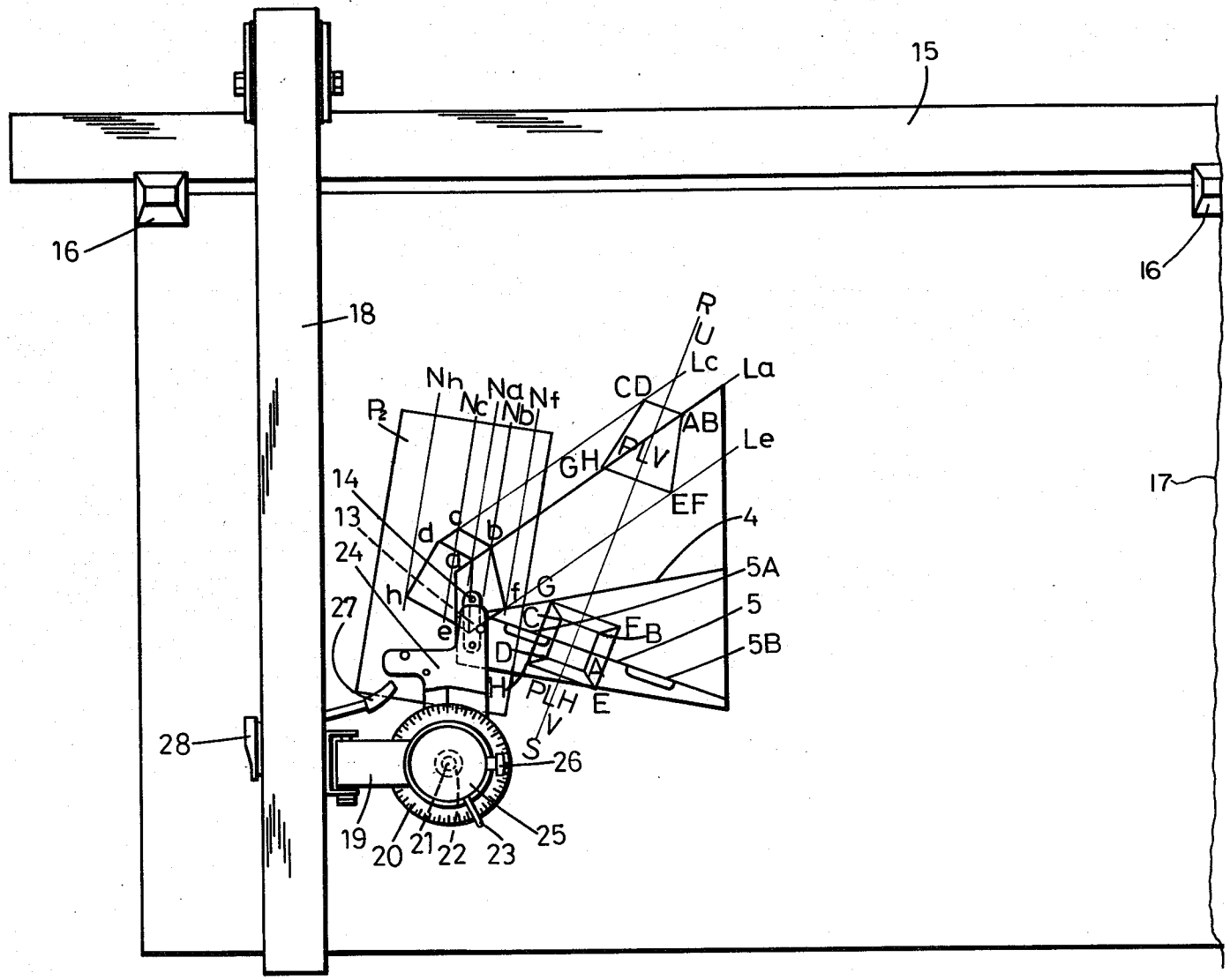

Subsequently, the lever 27 is unlocked and rendered movable vertically and horizontally. The index lever 26 is released, and the ruler mounting arm 24 is turned counterclockwise through 90° as seen in FIG. 8 and is thereafter locked. Lines La, Lb, . . . are drawn through the points of the front view PLV with the use of the ruler which is now in the same position as in FIG. 5. The intersections a, b, . . . of the lines La and Na, lines Lb and Nb, . . . drawn through the points corresponding to identical points provide points of an axonometric projection drawing. Thus, the drawing can be made. This embodiment is advantageous in that the ruler is easy to use since a T-square and set square can be dispensed with. The attaching member 13 need not always be perpendicular to the phantom line PQ but may be at any desired angle therewith. In this case, the mounting arm 24 must be turned clockwise through this angle first (namely to the position where the line PQ will be vertical) and then locked. The angle for this procedure is easily determinable if the attaching member 13 is positioned in parallel to the phantom line PQ or the first edge 2.

The embodiment in which the attaching member 13 is provided in parallel to the first edge 2 and which is provided with the reduction scale to be described later is advantageous in directly making axonometric projection drawing because the direction of the axis OZ on the drawing is vertical.

Figure 9:
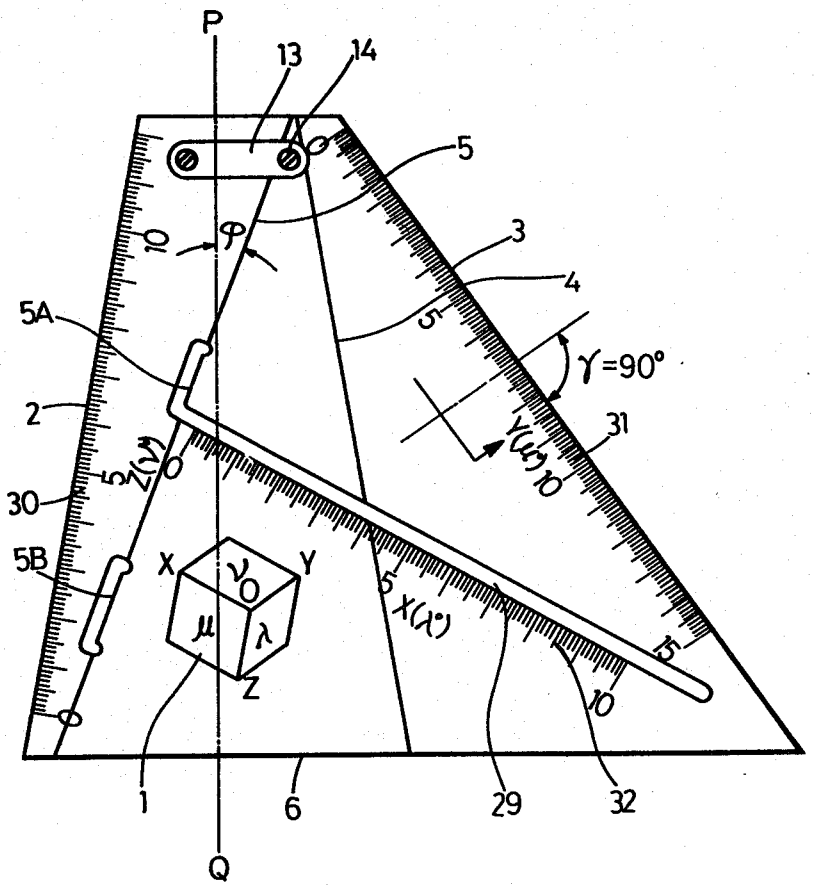

FIG. 9 shows another embodiment in which the ruler of FIG. 6 is provided with an edge (fourth edge) 29 in the direction of the main projection axis OX. The edges 2, 3 and 29 are provided with reduction scales 30, 31 and 32 for the corresponding main projection axes respectively. The scales are marked with symbols Z, Y, X representing the main projection axes OZ, OY, OX and with projection angles $\nu°$, $\mu°$, $\lambda°$ After an axonometric projection drawing has been schematically made by using the ruler in the foregoing manner, details are constructed with lines drawn in the directions of the main projection axes OX, OY, OZ of the axonometric projection drawing 1 on the ruler. With the use of the scale X, actual dimensions in the direction AD of the orthographic projection drawing give dimensions in the direction ad for the axonometric projection drawing.

In the case of simple drawings, an axonometric projection drawing can be drawn utilizing the main projection axes OX, OY, OZ without following the foregoing procedure, and the dimensions of the projected drawing are determinable with the use of reduction scales. Since the present embodiment includes three reduction scales in the directions OX, OY, OZ as arranged in the form of a closed triangle, the ruler is compact and convenient to handle.

Figure 10:
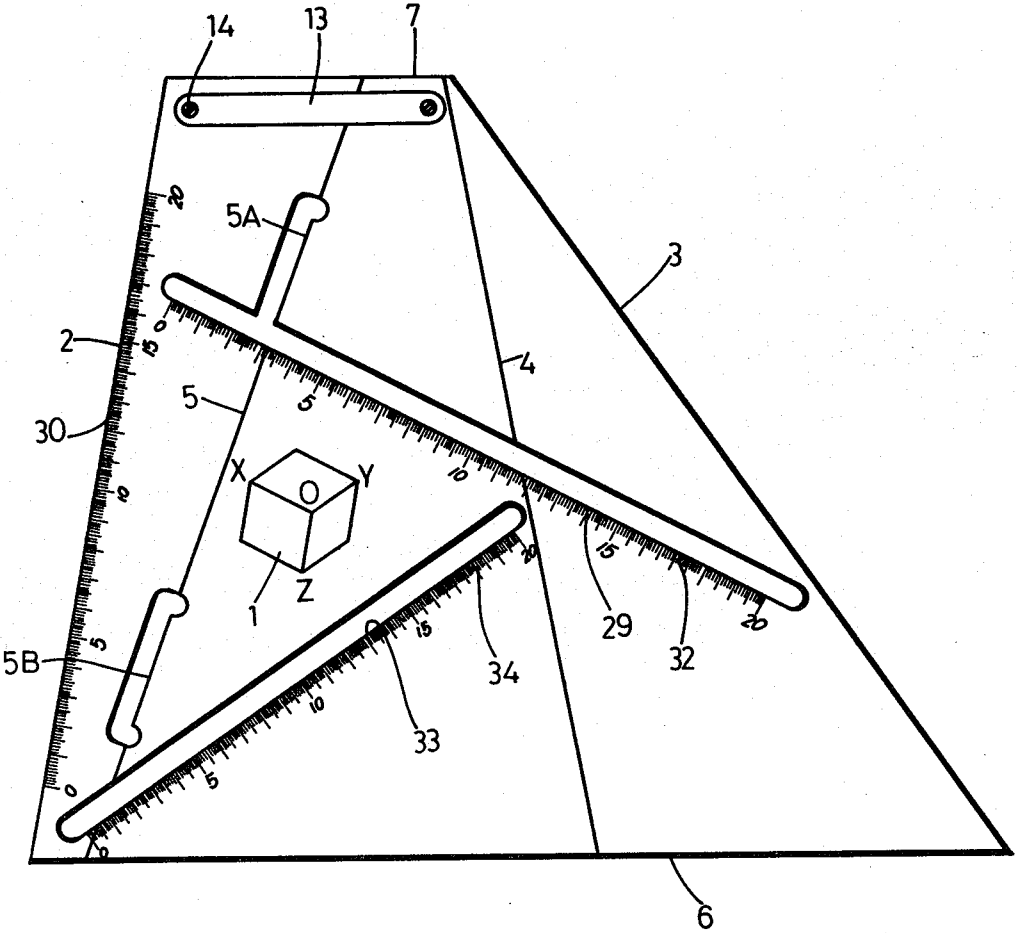

FIG. 10 shows another embodiment in which the ruler of FIG. 9 is formed with an edge 33 parallel to the main projection axis OY. The edge 33 is provided with a reduction scale 34 therealong in the direction OY.

Figure 11:
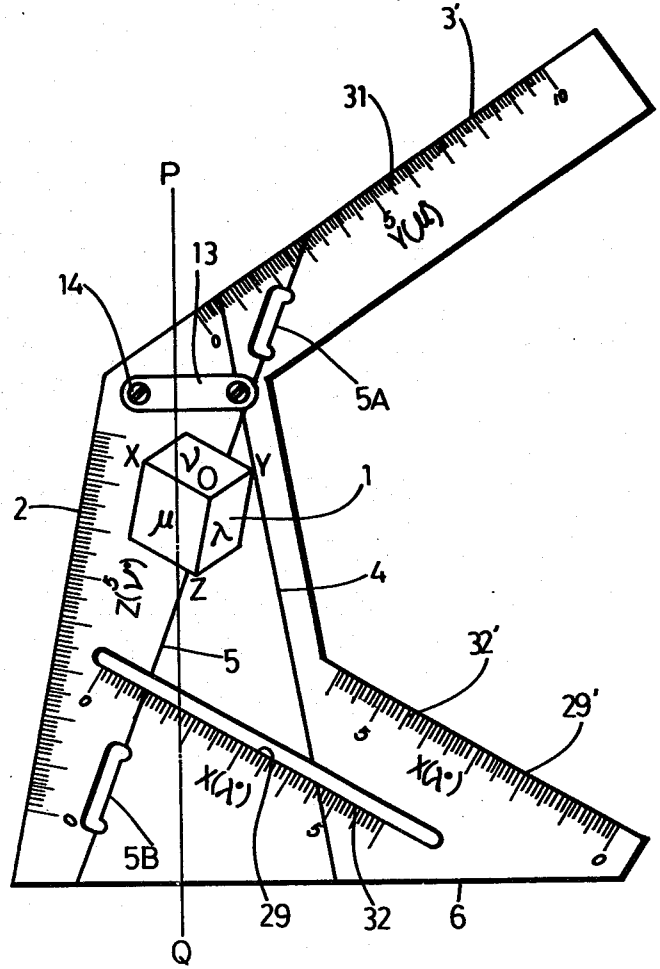
Figure 12:
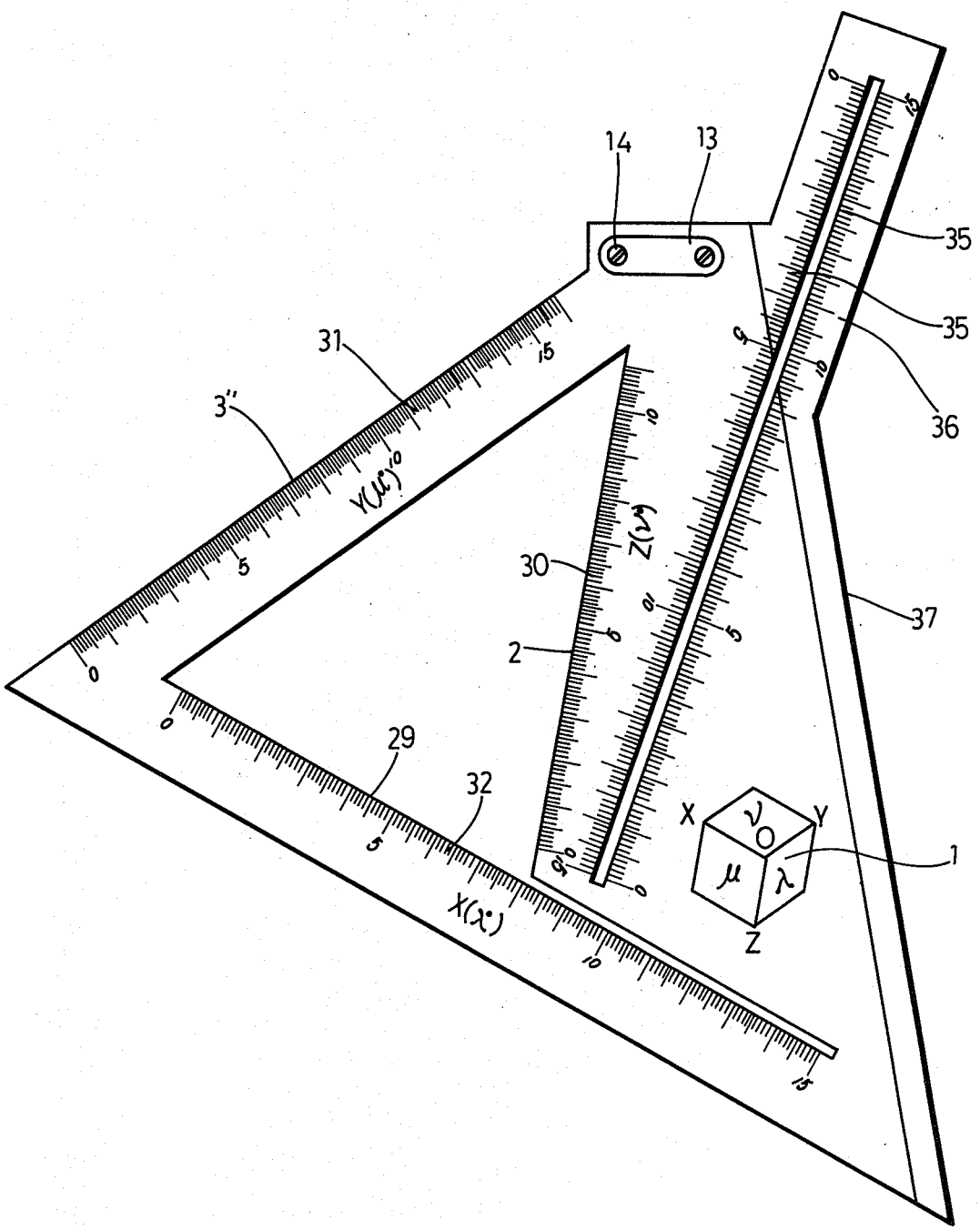
Figure 14:
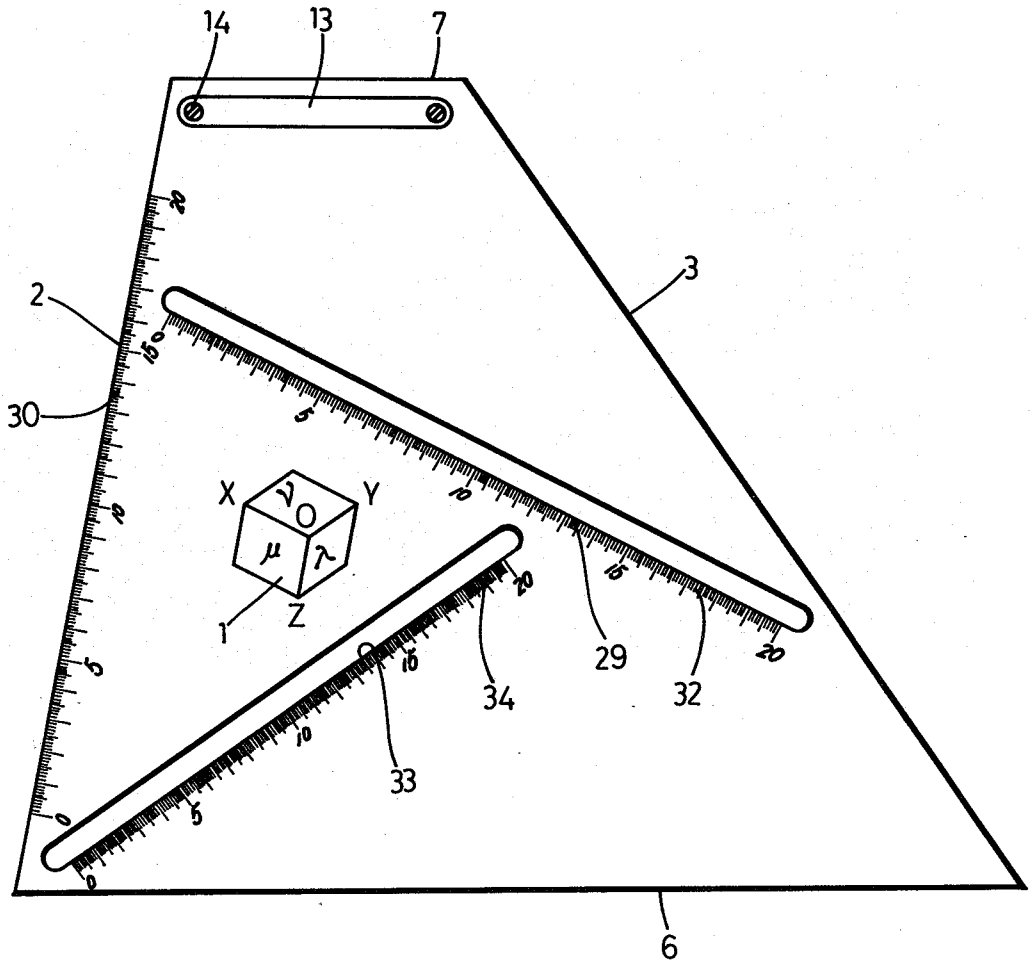

FIGS. 11 and 12 show embodiments in which the second edge 3' is parallel to the main projection axis OY, namely the angle $\gamma$ is 0°.

With the ruler of FIG. 11, a second edge 3' extends in parallel to the main projection axis OY from one end of the first edge 2 and is provided with a reduction scale 31. The ruler has another edge 29' parallel to the fourth edge 29 and provided with a scale 32' as an extension of the scale 32.

The ruler of FIG. 12 is provided with edges 35, 35 in place of the standard line 5 of the ruler shown in FIG. 9. The edge 35 is provided therealong with a scale 36 for actual dimensions. The ruler further has an edge 37 substituting for the standard line 4 and a second edge 3'' on the left side of the first edge 2.

With the foregoing embodiments, the specified angle $\gamma$ formed by the second edge 3, 3' or 3'' and the main projection angle OY may be any value of 0° to 360°. However, for use with the above-mentioned drawing instrument, the angle is preferably 90° or 0°. If the angle $\gamma$ is 0°, the ruler mounting arm 24 need not be turned counterclockwise through 90° when making axonometric projection drawings.

The rulers equivalent to the foregoing rulers as laterally reversed are also useful, in which case the axonometric projection drawings obtained respresent cubes as they are seen from above on the left-hand side thereof. In other words, the drawings obtained are axonometric projection drawings made by the foregoing rulers and laterally turned over.

The attaching member 13 may be disposed on the bisector PQ of the inversion angle $2\theta$ or in parallel to the bisector. In this case, the protractor 20 is turned clockwise through 90° and then clocked by the lever 23 on the drawing instrument.

Figure 13:
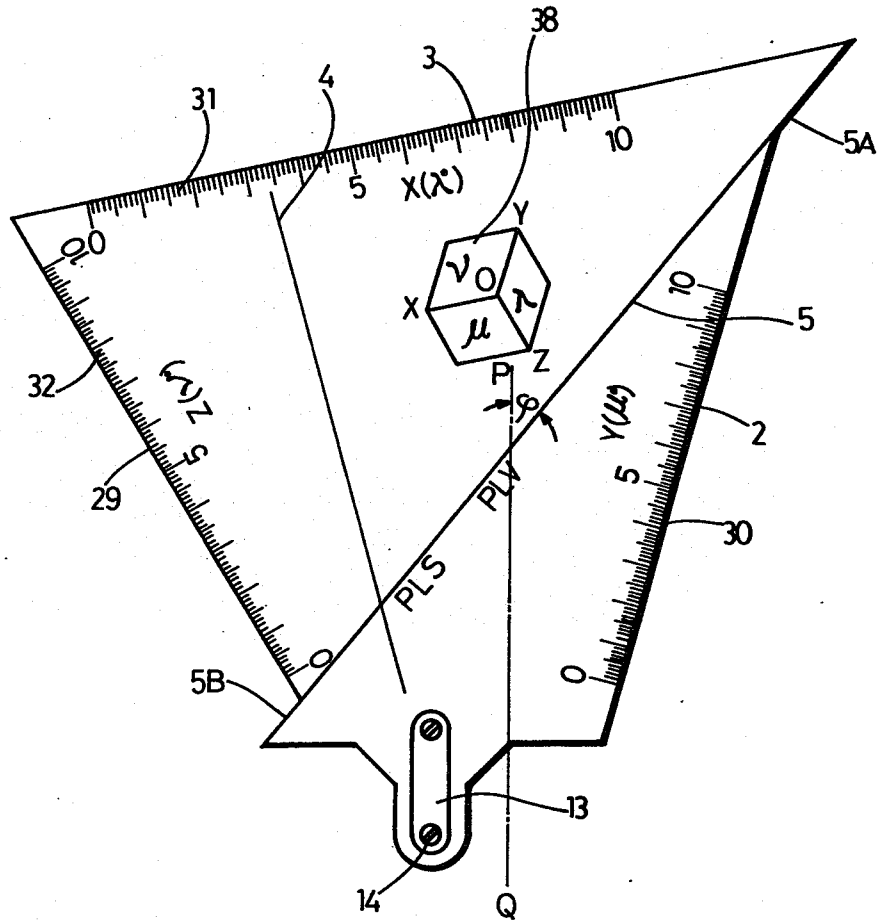
FIGS. 9 to 14 are front views of various other embodiments of the ruler of this invention.

FIG. 13 shows a ruler embodying this invention for use in making an axonometric projection drawing from a front view and a side view drafted by orthographic projection. The ruler bears on its surface an axonometric projection drawing 38 of a cube and has edges 2, 3 and 39 extending in the directions of the main projection axes OY, OX and OZ of the drawing 38. The three edges are provided with reduction scales 29, 30 and 31 for the corresponding main projection axes respectively. The ruler has a standard line 4 at an angle equal to an inversion angle with the edge 2 and another standard line 5 at an angle equal to an inclination angle $\phi$ of orthographic projection drawing with respect to the phantom bisector PQ of the inversion angle. The ruler further has edges 5A and 5B in alignment with the standard line 5. The ruler has a ruler attaching member 13 in parallel to the line PQ.

When the ruler of FIG. 13 is used for making axonometric projection drawings, the ruler is attached to the ruler mounting arm on the drawing instrument in vertically opposed relation to the ruler of FIG. 6, namely with the attaching member 13 down. Lines through the respective points of an orthographic projection side view PLS are drawn along the edge 3. Subsequently, the standard line 4 is placed on the respective points of an orthographic projection front view PLV, with the arm 19 locked to the vertical rail 18, to draw lines along the edge 2 and provide intersections with the lines on the PLS, whereby an axonometric projection drawing will be obtained.

The angles $\alpha$, $\beta$, $2\theta$ and $\phi$ in the embodiments described are constant angles dependent on the kind of the axonometric projection drawing to be drawn. The kinds of axonometric projection drawings are expressed usually in terms of projection angles $\lambda$, $\mu$ and $\nu$ as will be exemplified below.

I. Axonometric projection drawings to be made from orthographic projection plan view and front view by the plan view emitter method (1) For isometric projection drawings in which $\lambda=\mu=\nu=35°16'$:
$\alpha=15°$
$\beta=75°$
$2\theta=30°$
$\phi=30°$ (2) For dimetric projection drawings in which for example $\lambda=\mu=30°$ and $\nu=45°$:
$\alpha=22°30'$
$\beta=77°14'$
$2\theta=25°32'$
$\phi=32°14'$ (3) For trimetric projection drawings in which for example $\lambda=24°6'$, $\mu=45°$ and $\nu=35°16'$:
$\alpha=34°52'$
$\beta=79°52'$
$2\theta=20°16'$
$\phi=19°52'$ II. Axonometric projection drawings to be made from orthographic projection front view and side view by the front view emitter method.

(1) For isometric projection drawings in which $\lambda=\mu=\nu=35°16'$:
$\alpha=15°$
$\beta=75°$
$2\theta=30°$
$\phi=30°$ (2) For dimetric projection drawings in which for example $\lambda=\mu=30°$ and $\nu=45°$:
$\alpha=0$
$\beta=70°32'$
$2\theta=38°56'$
$\phi=35°16'$ (3) For trimetric projection drawings in which for exemple $\lambda=24°6'$, $\mu=45°$ and $\nu=35°16'$:
$\alpha=11°18.5'$
$\beta=74°44.5'$
$2\theta=30°31'$
$\phi=39°28.5'$ As already stated, axonometric projection drawings can be made with ease from plan and front views or front and side views drafted by orthographic projection with the use of the rulers of this invention having a greatly simplified structure as compared with the drawing instruments conventionall used in making axonometric projection drawings from orthographic projection drawings.

I claim:

1. A ruler for use in making axonometric projection drawings having three main axes, said ruler comprising a transparent plate having a base edge, a first edge means forming a predetermined angle with respect to said base for alignment in parallel with one axis of the three main axes; a second edge means forming a second predetermined angle with respect to said base for alignment at an angle $\gamma$ with another of the three main axes; a first standard line means on said plate forming an inversion angle $2\theta$ with respect to said first edge; and a second standard line means on said plate forming an angle $\phi$ with respect to the bisector of the angle $2\theta$.

2. A ruler as defined in claim 1 including attaching means for attaching the ruler to a drawing instrument.

3. A ruler as defined in claim 1 wherein the second edge means is at an angle $\gamma$ of 90° with one of the main projection axes.

4. A ruler as defined in claim 1 wherein the second edge means is parallel to one of the main projection axes.

5. A ruler as defined in claim 4 including a third edge means parallel to the third main projection axis, the first edge means, the second edge means and the third edge means each having a scale of reduction thereon wherein, the ruler has the three main projection axes on the surface thereof.

6. A ruler as defined in claim 1 wherein at least one of said first and second standard line means is marked on the surface of the ruler.

7. A ruler as defined in claim 1 wherein at least one of said first and second standard lines means is an edge.

8. A ruler as defined in claim 2 wherein the attaching means is perpendicular to the bisector of the angle $2\theta$.

9. A ruler as defined in claim 2 wherein the attaching means is parallel to the bisector of the angle $2\theta$.

10. A ruler as defined in claim 2 wherein the second edge means is at an angle $\gamma$ of 90°.

11. A ruler as defined in claim 2 wherein the second edge means is parallel to one of the main projection axes.

12. A ruler as defined in claim 11 including a third edge means parallel to the third main projection axes, the first edge means, the second edge means and the third edge means each having a scale of reduction thereon, wherein the ruler has the three main projection axes on the surface thereof.

13. A ruler as defined in claim 2 wherein at least one of said first and second standard line means is marked on the surface of the ruler.

14. A ruler as defined in claim 2 wherein at least one of said first and second standard line means is an edge.

15. A ruler for use in making axonometric projection drawings having three main axes of projection, said ruler comprising a transparent plate, a first edge means for alignment with one of said main axes; a second edge means positioned at an acute angle with respect to said first edge means for alignment with a second of said main axes; and a third edge means positioned at an acute angle with respect to said first and second edge means, for alignment with the third of said main axes, each of said edges having a reduction scale formed therealong.

* * * * *